US008277137B2

(12) United States Patent
Sawata

(10) Patent No.: US 8,277,137 B2
(45) Date of Patent: Oct. 2, 2012

(54) COATING MATERIAL EXTRUDING CONTAINER

(75) Inventor: Yasuhiro Sawata, Saitama (JP)

(73) Assignee: Tokiwa Corporation, Gifu (JP)

( * ) Notice: Subject to any disclaimer, the term of this patent is extended or adjusted under 35 U.S.C. 154(b) by 575 days.

(21) Appl. No.: 12/473,922

(22) Filed: May 28, 2009

(65) Prior Publication Data

US 2009/0297249 A1 Dec. 3, 2009

(30) Foreign Application Priority Data

May 28, 2008 (JP) ..... P2008-139892

(51) Int. Cl.
*B43K 1/06* (2006.01)

(52) U.S. Cl. ..... 401/265; 401/172; 401/175; 401/266; 222/390

(58) Field of Classification Search ..... 401/171, 401/172, 174, 175, 262, 263, 265; 222/386, 222/390

See application file for complete search history.

(56) References Cited

U.S. PATENT DOCUMENTS

| | | | | |
|---|---|---|---|---|
| 6,155,735 | A * | 12/2000 | Nakajima | 401/172 |
| 7,201,526 | B2 * | 4/2007 | Tani | 401/172 |
| 2007/0086830 | A1 * | 4/2007 | Kageyama | 401/172 |

FOREIGN PATENT DOCUMENTS

| | | |
|---|---|---|
| JP | 3-17787 | 2/1987 |
| JP | 2004-141639 | 5/2004 |
| JP | 2006-158777 | 2/2006 |
| JP | 2006-150098 | 6/2006 |
| JP | 2008-43590 | 2/2008 |

OTHER PUBLICATIONS

Japanese Notice of Allowance for Japanese Application No. 2008-139892, mailed on Apr. 13, 2010 (2 pages).
Patent Abstracts of Japan for Japanese Publication No. 2008-043590, Publication date Feb. 28, 2008 (1 page).
Patent Abstracts of Japan for Japanese Publication No. 2006-158777, Publication date Jun. 22, 2006 (1 page).
Patent Abstracts of Japan for Japanese Publication No. 2004-141639, Publication date May 20, 2004 (1 page).
esp@cenet patent abstract for Japanese Publication No. 2006150098, Publication date Jun. 15, 2006 (1 page).

* cited by examiner

*Primary Examiner* — Steven J Ganey
(74) *Attorney, Agent, or Firm* — Osha Liang LLP

(57) ABSTRACT

To generate a sense of click according to the movement of a moving member, reset screwing sections to screw in when a screwing action of the screwing sections is released, and reduce the number of components. In a container 100, when a main body cylinder 2 and an operation cylinder 3 are relatively rotated in an extending direction and relatively rotated in a retracting direction, a female screw member 5 and a moving member 4 relatively rotate, the moving member 4 moves forward and moves backward according to a screwing action of screwing sections 8, and click teeth 54 and 64 also relatively rotate in synchronization with each other. Since an elastic body 61 urges the click teeth 64 toward the click teeth 54, a sense of click is given when the moving member 4 moves forward and moves backward. In addition, when the moving member 4 moves backward according to the relative rotation and a screwing action of screwing sections 8 is released, the elastic body 61 urges the screwing sections 8 to be reset to screw in according to the relative rotation in the opposite direction. In other words, the elastic body 61 is shared to realize the giving of a sense of click according to the movement of the moving member 4 and the reset for screw-in of the screwing sections 8.

9 Claims, 13 Drawing Sheets

COATING MATERIAL EXTRUDING CONTAINER

BACKGROUND OF THE INVENTION

1. Field of the Invention

The present invention relates to a coating material extruding container for extruding a coating material to use the same.

2. Related Background Art

As a coating material extruding container in the past, for example, a coating material extruding container disclosed in Japanese Patent Laid-Open No. 2006-150098 is known. In this coating material extruding container, when an main body cylinder (a container front section) and an operation cylinder (a container rear section) are relatively rotated in one direction, a screwing action of screwing sections works, a movable body moves forward, and a coating filler (a coating material) is extruded from an opening at a distal end of the container. On the other hand, when the main body cylinder and the operation cylinder are relatively rotated in the other direction, the screwing action of the screwing sections works and the movable body moves backward. The coating material extruding container includes click teeth and a compression spring section (an elastic body). When the movable body moves forward and backward, one of the click teeth is urged toward the other by the compression spring section. Therefore, a sense of click is generated according to the movement of the movable body. It is possible to cause a user to sense a state of forward movement and a state of return of the movable body.

As the coating material extruding container in the past, for example, a coating material extruding container disclosed in Japanese Utility Model Publication No.Hei-3-17787 is known. In this coating material extruding container, a core holding shaft protrusion (a male screw of screwing sections) provided at a rear end of a core holding shaft (a movable body) is screwed in a spiral groove (a female screw of the screwing sections) provided in a spiral cylinder. When a front cylinder (a container front section) and a turning cylinder (a container rear section) are relatively rotated in one direction, a screwing action of the spiral groove of the spiral cylinder and the holding shaft protrusion works, the core holding shaft moves forward, and a cosmetics core (a coating material) is extruded from a distal end of the container. On the other hand, when the front cylinder and the turning cylinder are relatively rotated in the other direction, the screwing action of the spiral groove and the holding shaft protrusion works and the core holding shaft moves backward. In the coating material extruding container, when the core holding shaft moves backward according to the relative rotation in the other direction and the holding haft protrusion comes off from a rear end of the spiral groove, the holding shaft protrusion enters between a rear end of the spiral cylinder and a front end of an elastic member (an elastic body), the elastic member is pushed backward to be compressed, and the holding shaft protrusion is pushed back forward. Therefore, when the front cylinder and the turning cylinder are relatively rotated in one direction after the holding shaft protrusion comes off from the rear end of the spiral groove, the spiral groove and the holding shaft protrusion can be reset to screw in.

SUMMARY OF THE INVENTION

In the coating material extruding container explained above, a sense of click is generated by the movement of the movable body and the screwing sections can be reset to screw in when the screwing action of the screwing sections is released. In this case, the elastic body for urging one of the click teeth to the other and the elastic body for urging the screwing sections when the screwing action is released are provided as separate components. Therefore, the number of components is large.

Therefore, it is an object of the present invention to provide a coating material extruding container that can generate a sense of click with the movement of a movable body, reset screwing sections to screw in when a screwing action of the screwing sections is released, and reduce the number of components.

In order to attain the object, a coating material extruding container according to the present invention includes a movable body and screwing sections in the container. When a container front section and a container rear section rotatable relative to the container front section are relatively rotated in one direction, a screwing action of the screwing sections works, the movable body moves forward, a coating material is extruded from an opening at a distal end of the container. When the container front section and the container rear section are relatively rotated in the other direction opposite to the one direction, the screwing action of the screwing sections works and the movable body moves backward. The coating material extruding container includes click teeth for giving a sense of click according to the movement of the movable body following the relative rotation and an elastic body having a predetermined elastic force. The elastic body urges one of the click teeth toward the other of the click teeth. When the movable body moves backward according to the relative rotation in the other direction and the screwing action of the screwing sections is released, the elastic body urges the screwing sections to be reset to screw in according to the relative rotation in the one direction.

A coating material extruding container according to the present invention includes a movable body and screwing sections in the container. When a container front section and a container rear section rotatable relative to the container front section are relatively rotated in one direction, a screwing action of the screwing sections works, the movable body moves forward, a coating material is extruded from an opening at a distal end of the container. When the container front section and the container rear section are relatively rotated in the other direction opposite to the one direction, the screwing action of the screwing sections works and the movable body moves backward. The coating material extruding container includes click teeth for giving a sense of click according to the movement of the movable body following the relative rotation and an elastic body having a predetermined elastic force. The elastic body urges one of the click teeth toward the other of the click teeth. When the movable body moves forward according to the relative rotation in the one direction and the screwing action of the screwing sections is released, the elastic body urges the screwing sections to be reset to screw in according to the relative rotation in the other direction.

In such a coating material extruding container, the elastic body urges one of the click teeth toward the other and generates a sense of click involved in the movement of the movable body. In addition, when the movable body moves backward according the relative rotation in the other direction and the screwing action of the screwing sections is released or when the movable body moves forward according to the relative rotation in one direction and the screwing action of the screwing sections is released, the elastic body urges the screwing sections to be reset to screw in according to the relative rotation in the opposite direction of the other direction or one direction. In other words, according to the present invention, it is possible to share one elastic body to realize both the giving of a sense of click according to the movement of the movable body and the reset for screw-in of the screwing sections, the screwing action of which is released. Therefore, it is possible to generate a sense of click according to the movement of the movable body, reset the screwing sections to screw in when the screwing action of the screwing sections is released, and reduce the number of components.

A coating material extruding container according to the present invention includes a movable body and screwing sections in the container. When a container front section and a container rear section rotatable relative to the container front section are relatively rotated in one direction, a screwing action of the screwing sections works, the movable body moves forward, a coating material is extruded from an opening at a distal end of the container. When the container front section and the container rear section are relatively rotated in the other direction opposite to the one direction, the screwing action of the screwing sections works and the movable body moves backward. The coating material extruding container includes click teeth for giving a sense of click according to the movement of the movable body following the relative rotation and an elastic body having a predetermined elastic force. The elastic body urges one of the click teeth toward the other of the click teeth. When the movable body moves backward according to the relative rotation in the other direction and the screwing action of the screwing sections is released, the elastic body urges the screwing sections to be reset to screw in according to the relative rotation in the one direction. When the movable body moves forward according to the relative rotation in the one direction and the screwing action of the screwing sections is released, the elastic body urges the screwing sections to be reset to screw in according to the relative rotation in the other direction.

In this coating material extruding container, there is the action and effect explained above, i.e., the effect that it is possible to generate a sense of click according to the movement of the movable body, reset the screwing sections to screw in when the screwing action of the screwing sections is released, and reduce the number of components. In particular, in the coating material extruding container, the screwing sections can be reset to screw in when the movable body moves backward and the screwing action of the screwing sections is released and when the movable body moves forward and the screwing action of the screwing sections is released.

It is preferable that a male screw forming one of the screwing sections is provided in the movable body, the movable body has a protrusion projecting in a direction crossing a moving direction, and the movable body is urged forward by compressing the elastic body with the protrusion in a state in which the movable body moves backward according to the relative rotation in the other direction and the screwing action of the screwing sections is released. In this case, the movable body moves backward according to the relative rotation in the other direction and the elastic body is compressed by the protrusion. In a state in which the screwing action is released, a compression elastic force of the elastic body is given to the movable body and the movable body is urged forward. Therefore, it is possible to rest the screwing sections to screw in according to the relative rotation in one direction after that.

The elastic body is externally inserted in the movable body. The movable body is formed in a bar shape and can move in an axial direction with respect to the elastic body. In a state in which the movable body moves backward according to the relative rotation in the other direction and the screwing action of the screwing sections is released, the elastic body may be compressed by pressing the elastic body backward with the protrusion while locking the elastic body to the container to prevent backward movement of the elastic body.

It is preferable that a female screw forming the other of the screwing sections is provided in a cylindrical female screw member and the female screw member is urged forward by moving the female screw member in the axial direction to compress the elastic body in a state in which the movable body moves forward according to the relative rotation in one direction and the screwing action of the screwing sections is released. In this case, the movable body moves forward according to the relative rotation in one direction and, for example, the female screw member is moved backward by reaction involved in such forward movement and the elastic body is compressed. In a state in which the screwing action is released, the compression elastic force of the elastic body is given to the female screw member and the female screw member is urged forward. Therefore, it is possible to reset the screwing sections to screw in according to the relative rotation in the other direction after that.

The movable body is formed in a bar shape. The male screw forming one of the screwing sections is provided on an outer circumferential surface thereof. In a state in which the movable body moves forward according to the relative rotation in one direction and the screwing action of the screwing sections is released, the elastic body may be compressed by moving the female screw member backward with a reaction involved in the forward movement of the movable body and pressing the elastic body backward with the female screw member while locking the elastic body to the container to prevent backward movement of the elastic body.

DESCRIPTION OF THE PREFERRED EMBODIMENTS

Figure 1:
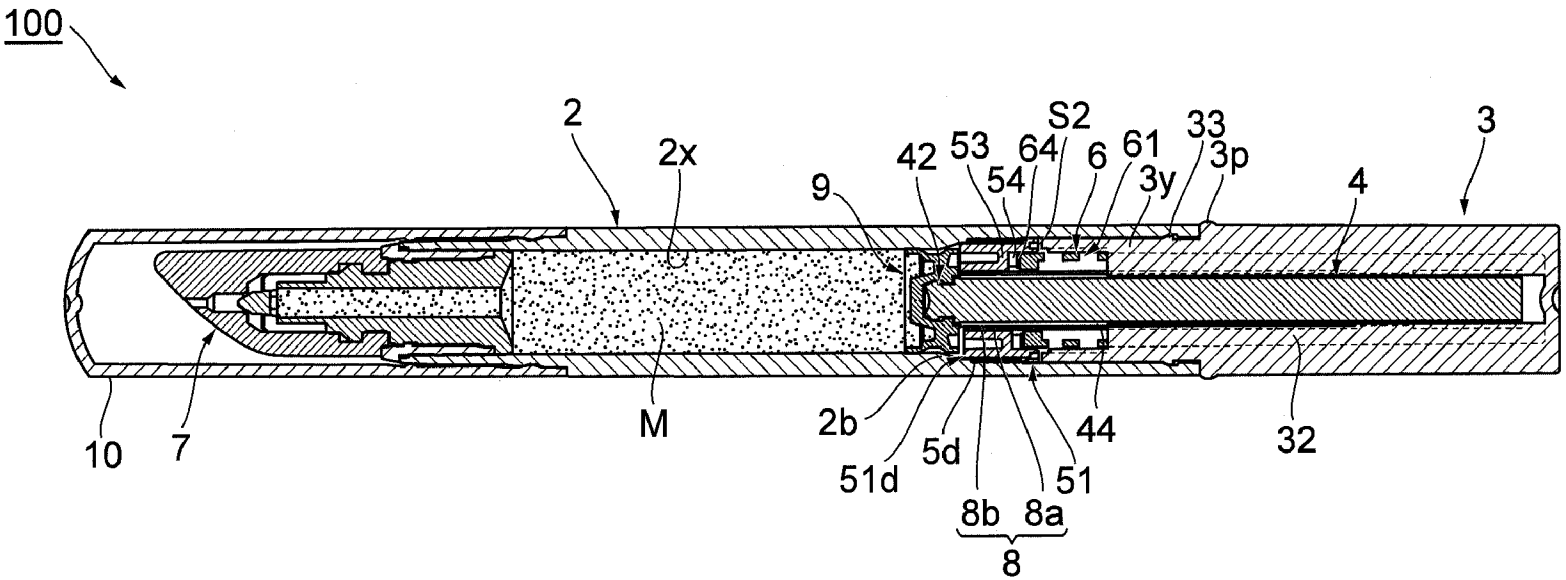
FIG. 1 is a longitudinal sectional view of an initial state of a coating material extruding container according to a first embodiment of the present invention.

Embodiments of the present invention are explained in detail below with reference to the accompanying drawings. In the following explanation, same or equivalent components are denoted by the same reference numerals and signs and redundant explanation of the components is omitted.

Figure 2:
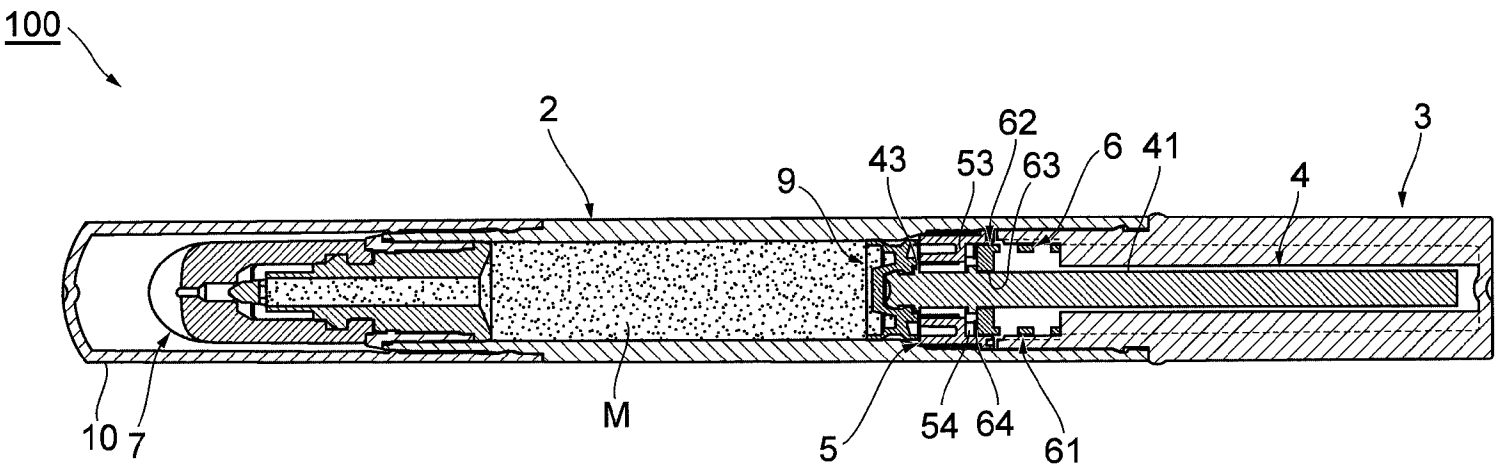
FIG. 2 is a longitudinal sectional view in which a longitudinal section position shown in FIG. 1 is set in a position different by 90°.
Figure 3:
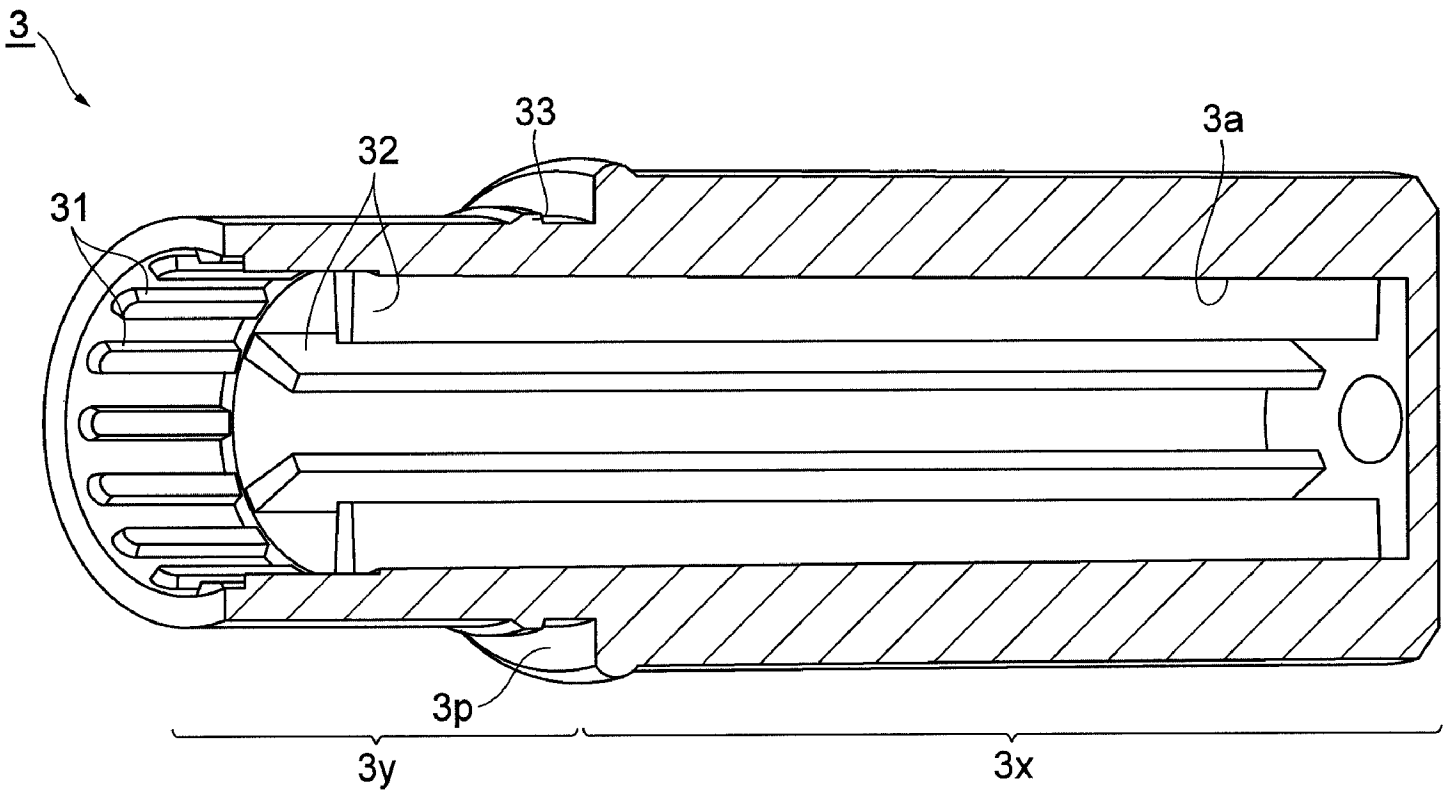
FIG. 3 is a sectional perspective view of an operation cylinder in the coating material extruding container shown in FIG. 1.
Figure 4:
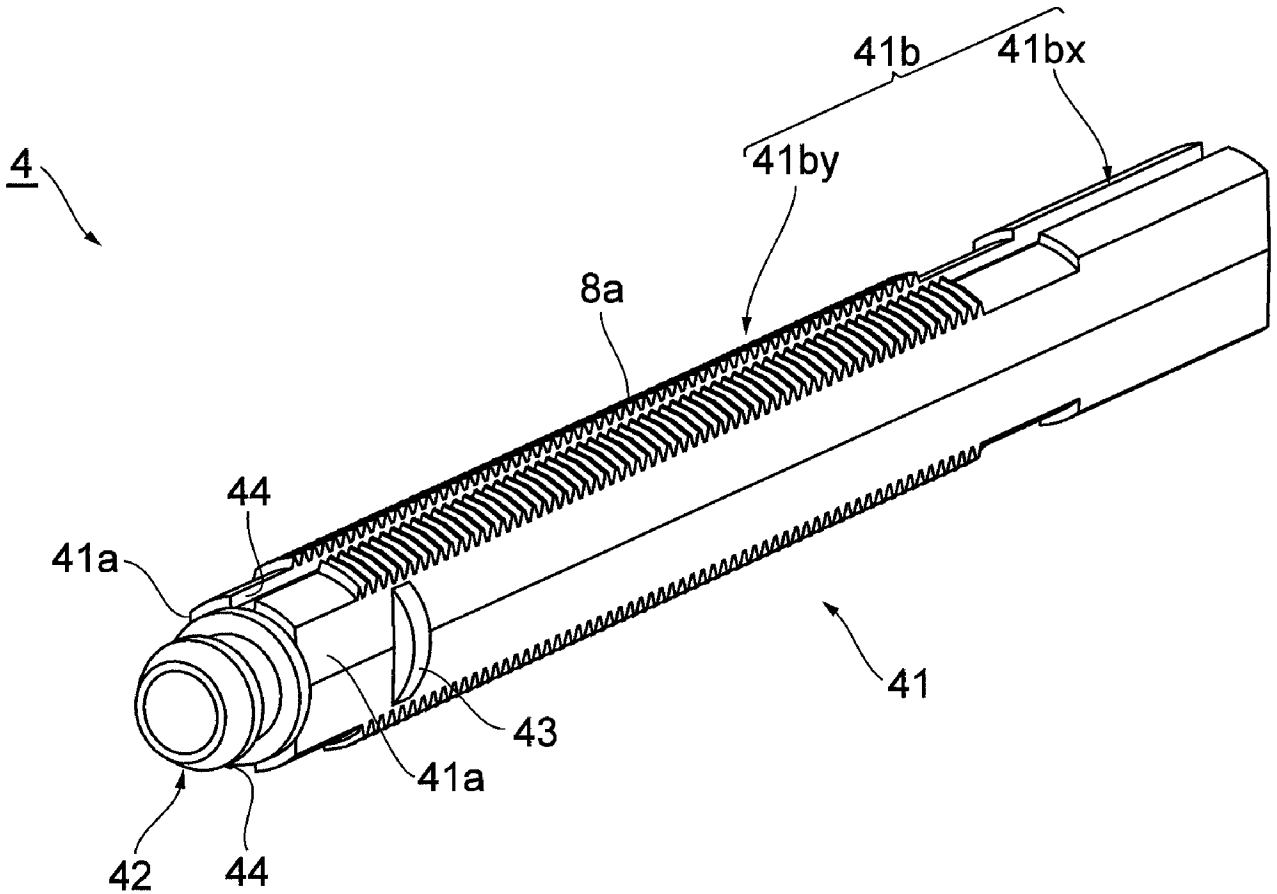
FIG. 4 is a perspective view of a movable body in the coating material extruding container shown in FIG. 1.
Figure 5:
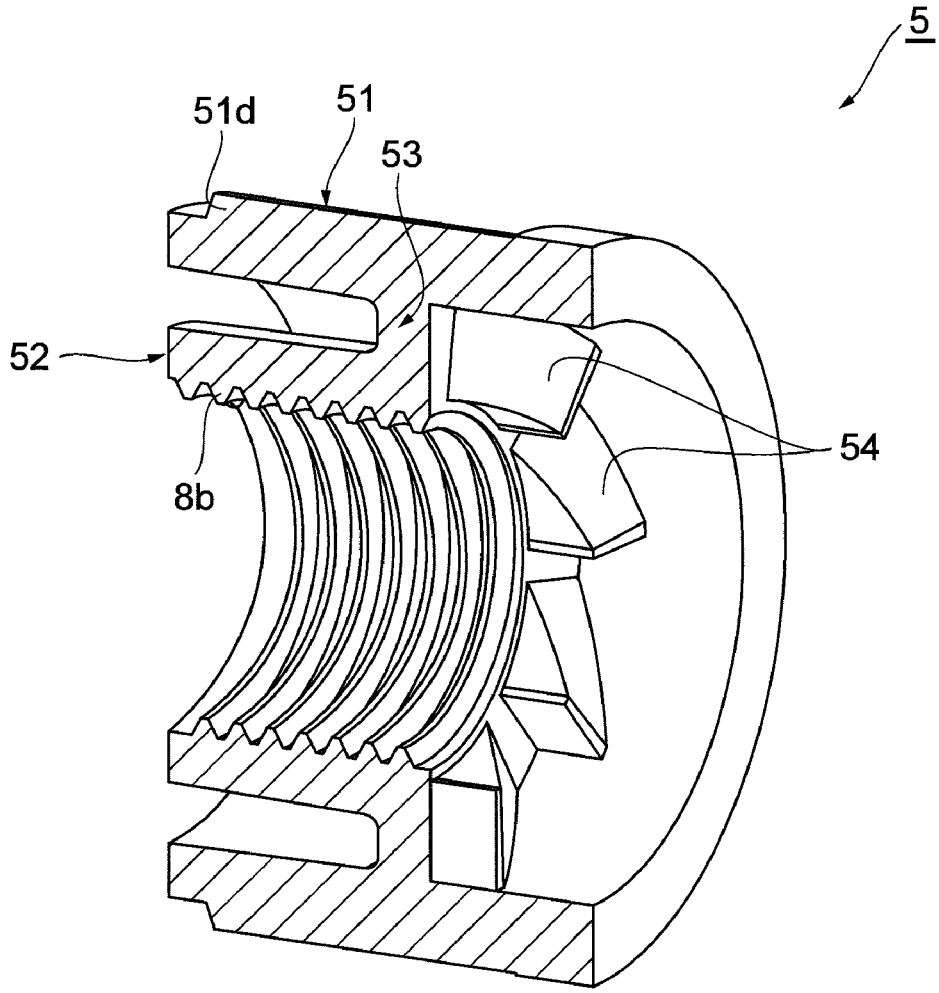
FIG. 5 is a sectional perspective view of a click female screw member in the coating material extruding container shown in FIG. 1.
Figure 6:
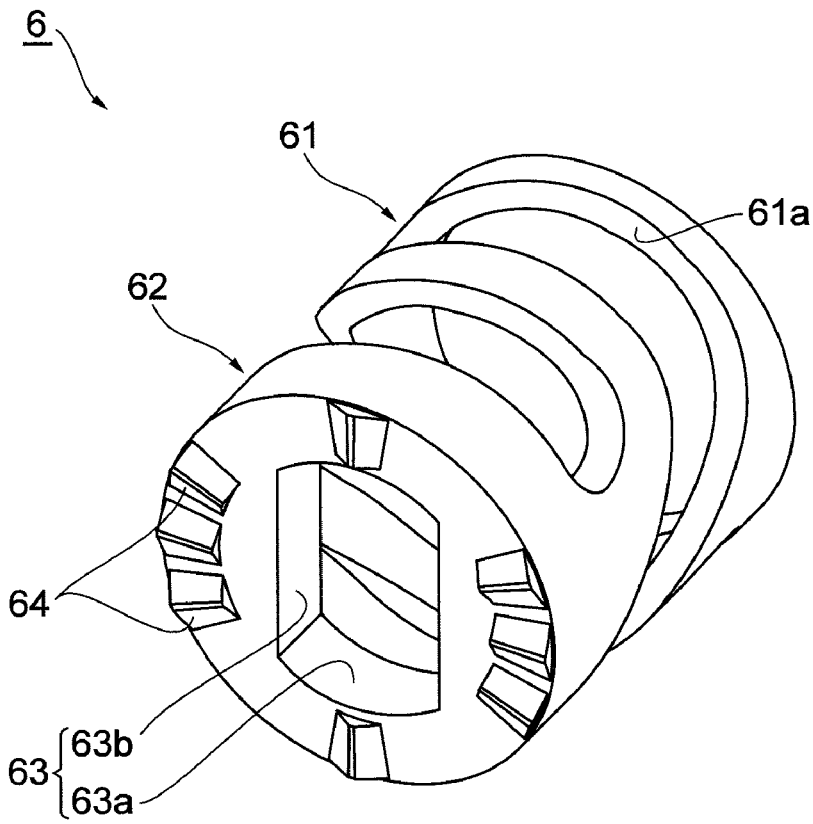
FIG. 6 is a perspective view of a spring member in the coating material extruding container shown in FIG. 1.

FIGS. 1 and 2 are longitudinal sectional views of an initial state of a coating material extruding container according to a first embodiment of the present invention. FIG. 3 is a sectional perspective view of an operation cylinder. FIG. 4 is a perspective view of a movable body. FIG. 5 is a sectional perspective view of a click female screw member. FIG. 6 is a perspective view of a spring member. The coating material extruding container according to this embodiment stores a coating material and can be extruded and retracted according to the operation by a user.

As a coating material, it is possible to use a semi-solid body, a soft solid body, and the like including liquid-like, jelly-like, gel-like, and milled bodies including paste-like bodies such as a lip gloss, a lipstick, an eye color, an eye liner, cosmetic liquid, cleansing liquid, nail enamel, nail care solution, nail remover, mascara, an anti-aging agent, a hair color, hair cosmetics, aural care products, massage oil, keratin release liquid, foundation, concealer, skin cream, ink for writing implements such as a marking pen, liquid medicines, and mud-like products.

As shown in FIG. 1, a coating material extruding container 100 includes, as outer components, a cylindrical main body cylinder 2 including a filling area 2*x* in which a coating material M is filled, a coating instrument (a container tip) 7 attached to a front end of the main body cylinder 2 and used for coating the coating material M, which is extruded from the filling area 2*x*, over the skin, and a bottomed cylindrical operation cylinder 3 coupled to a rear end of the main body cylinder 2 to be relatively rotatable and unremovable in an axial direction. The main body cylinder 2 and the coating instrument 7 configure a container front section and the operation cylinder 3 configures a container rear section. A cap 10 as a protective member is detachably mounted on a front end side of the main body cylinder 2 to cover the coating instrument 7. An "axis" means a center line extending to front and back of the coating material extruding container 10 (the same applies in the following explanation).

In the inside of the coating material extruding container 100, a bar-like movable body 4 including a piston 9 at a distal end thereof and used for extruding the coating material M, a click female screw member 5 screwed to the movable body 4 via screwing sections 8 and used for giving a sense of click, and a spring member 6 for giving a sense of click in cooperation with the click female screw member 5 and allowing the screwing sections 8 to be reset to screw in are disposed.

As shown in FIG. 3, the operation cylinder 3 is formed in a stepped cylindrical shape and includes an outer large diameter section 3*x* on a rear side and an outer small diameter section 3*y* further on a front side than the outer large diameter section 3*x* via a step section 3*p*. Roulettes 31 in which a large number of recesses and projections are provided in parallel in a circumferential direction and extend in an axial direction by predetermined length are provided at a front end on an inner circumferential surface 3*a* of the operation cylinder 3. Ridges 32 extending in the axial direction are provided as a section for engaging with the movable body 4 in a rotating direction in six equally distributed positions along the circumferential direction on the inner circumferential surface 3*a* extending from a rear side to a rear end of the roulettes 31. An annular projection 33 for engaging with the main body cylinder 2 in the axial direction is provided on an outer circumferential surface of the outer small diameter section 3*y*.

As shown in FIG. 1, the outer small diameter section 3*y* is inserted in the main body cylinder 2 and the annular projection 33 engages with the main body cylinder 2 in the axial direction, whereby the operation cylinder 3 is attached to be rotatable with respect to the main body cylinder 2 and unremovable in the axial direction.

As shown in FIG. 4, the movable body 4 includes an shaft 41 formed in a shape obtained by providing two plane sections 41*a* and 41*a* to be opposed to each other on an outer circumference of a columnar shape. In other words, the movable body 4 includes the shaft 41 in which the two plane sections 41*a* and 41*a* as cut surfaces, which are formed to cut a part of the columnar shape, are disposed to be opposed to each other in a direction orthogonal to the axial direction.

On an outer circumferential surface 41*b* excluding the two plane sections 41*a* and 41*a* of the shaft 41, grooves 44 extending over substantially the entire length in the axial direction are provided to be opposed to each other as sections with which the opposed ridges 32 of the operation cylinder 3 engage. The outer circumferential surface 41*b* is formed in a stepped shape in the axial direction and includes a large diameter outer circumferential surface 41*bx* on a rear side and a small diameter outer circumferential surface 41*by* on a front side. In an area excluding a front end and a rear end on the small outer circumferential surface 41*by*, a male screw 8*a* forming one of the screwing sections 8 is provided along the axial direction. The screwing sections 8 are preferably formed as a single thread screw.

On a distal end side of the two plane sections 41*a* and 41*a*, protrusions 43 projecting in a half-moon shape in an axial direction view are respectively provided as sections for compressing the spring member 6. The protrusions 43 are provided in positions in the axial direction where the protrusions 43 can come into contact with the spring member 6 in a state in which a screwing action of the screwing sections 8 is released (explained in detail later).

The movable body 4 includes a collar 42 provided on the distal end side of the shaft 41 and having a circular shape in a cross section as a section for engaging with the piston 9 in the axial direction.

As shown in FIG. 1, the movable body 4 is inserted in the operation cylinder 3 and the grooves 44 thereof engages with the ridges 32 of the operation cylinder 3, whereby the movable body 4 is attached to be rotatable synchronously with the operation cylinder 3 and movable in the axial direction. The piston 9 engages with the collar 42 thereof, whereby the movable body 4 is attached to make the piston 9 movable in the axial direction by a space S1 (so-called clearance: see FIG. 7) of predetermined length.

As shown in FIG. 5, the click female screw member 5 includes an outer cylinder 51, an inner cylinder 52 arranged on an inner side coaxially with the outer cylinder 51, an annular coupling section 53 that are connected to substantially the center in the axial direction of the outer cylinder 51 and a rear end of the inner cylinder 52 to couple the outer cylinder 51 and the inner cylinder 52.

Plural ridges 51d extending in the axial direction by predetermined length are provided on the circumferential surface of the outer cylinder 51, along the circumferential direction as sections that engage with the main body cylinder 1. A female screw 8*b* forming the other of the screwing sections 8 is provided along the axial direction over substantially the entire area of an inner circumferential surface of the inner cylinder 52. Axial direction length of a front end and a rear end where the male screw 8*a* is not provided on the small diameter outer circumferential surface 41 by of the shaft 41 of the movable body 4 is set to correspond to axial direction length of the female screw 8*b*.

The coupling section 53 includes plural click teeth 54 provided along the circumferential direction on a rear surface thereof and projecting backward. The click teeth 54 are teeth for giving a sense of click involved in the movement of the movable body 4 and formed in a saw tooth shape slanting to one side in the circumferential direction. The click teeth 54 are provided in eight equally distributed positions along the circumferential direction (i.e., at every 45° in the circumferential direction).

As shown in FIG. 1, the click female screw member 5 is inserted in the main body cylinder 2 from a front side thereof and the ridges 51*d* of the outer cylinder 51 engage with the main body cylinder 1 in the rotating direction around the axis, whereby the click female screw member 5 can be synchronous rotatable with respect to the main body cylinder 1. The female screw 8*b* of the click female screw member 5 is screwed in the male screw 8*a* of the movable body 4. The click female screw member 5 is prevented from moving further forward than the an inclined surface 2*b* on the inner circumferential surface of the main body cylinder 2 by the inclined surface 2*b* and is prevented from moving further backward than a front end face of the operation cylinder 3 by the front end face. The click female screw member 5 is disposed to be movable in the axial direction by a space S2 (so-called clearance) of predetermined length between the inclined surface 2*b* of the main body cylinder 2 and the front end face of the operation cylinder 3 in the coating material extruding container 100.

As shown in FIG. 6, the spring member 6 is formed in a bottomed cylindrical shape opening to a rear side and includes a spring section 61 and a disc section 62 on a front end side of the spring section 61. The spring section 61 includes a slit 61*a* that extends spirally along an outer circumferential surface and connects the inside and the outside. The spring section 61 is formed as a resin spring stretchable in the axial direction by the slit 61*a* and forms an elastic body having a predetermined elastic force in the axial direction (hereinafter referred to as elastic body 61). The elastic force of the elastic body 61 is set smaller than reaction involved in the forward movement of the movable body 4 preferable for causing a clutch action explained later to suitably function.

A through hole 63 corresponding to an external shape of the shaft 41 is formed in the disc section 62. An inner surface of the through hole 63 in the disc section 62 is formed in a noncircular shape in section having curved surface sections 63*a* and 63*a* and two plane sections 63*b* and 63*b*. Consequently, the spring member 6 can engage with the shaft 41 of the movable body 4 in the rotating direction. In addition, the male screw 8*a* of the shaft 41 can pass through the through hole 63 in the axial direction. On the other hand, the protrusion 43 of the shaft 41 cannot pass through the through hole 63. Therefore, the spring member can engage with the protrusion 43 in the axial direction.

The disc section 62 includes, on a front surface thereof, plural click teeth 64 projecting forward provided along the circumferential direction. The click teeth 64 are teeth for giving a sense of click involved in the movement of the movable body 4 in cooperation with the click teeth 54. The click teeth 64 are formed in a mountain shape having ascending inclination and descending inclination half by half along the circumferential direction. The click teeth 64 are provided in eight places not equally divided on the circumference. Specifically, the click teeth 64 are provided in four places at every 90° in the circumferential direction and four places rotated clockwise and counterclockwise by 22.5°, respectively. One click teeth 54 are formed in the saw tooth shape and the other click teeth 64 are formed in the mountain shape in this way, whereby a sense of click during extension and a sense of click during retraction can be changed from each other.

As shown in FIG. 1, the spring member 6 is arranged to be held between the coupling section 53 of the click female screw member 5 and the ridges 32 of the operation cylinder 3 such that the elastic body 61 is compressed by a predetermined amount in the axial direction between the coupling section 53 and the ridges 32. Specifically, the spring member 6 is inserted in the outer cylinder 51 of the click female screw member 5 from a front side thereof and inserted in the outer small diameter section 3*y* of the operation cylinder 3 from a rear side thereof. A rear surface of the spring member 6 is bumped against the ridges 32. Consequently, as shown in FIG. 2, in the spring member 6, the click teeth 64 of the disc section 62 are urged toward the click teeth 54 of the click female screw member 5 by the compression of the elastic body 61. The click teeth 64 can engage (mesh) with the click teeth 54 in the rotating direction around the axis. The through hole 63 of the disc section 62 is formed in a noncircular shape and externally inserted to fit in the shaft 41 of the movable body 4 from the front side thereof, whereby the spring member 6 is attached to be rotatable synchronously with the movable body 4 and such that the disc section 62 is movable in the axial direction.

In this embodiment, components configuring the coating material extruding container 100 such as the main body cylinder 2, the operation cylinder 3, the movable body 4, the click female screw member 5, and the spring member 6 are injection molded products of resin.

In the coating material extruding container 100 configured as explained above, when the main body cylinder 2 and the operation cylinder 3 are relatively rotated in an extending direction (one direction), the click female screw member 5 and the movable body 4 relatively rotate and the click teeth 54 and 64 also relatively rotate in synchronization with each other. Consequently, the screwing action of the screwing sections 8 works, the movable body 4 and the piston 9 move forward, and the coating material M is extruded from the opening at the distal end of the coating instrument 7. In addition, since the elastic body 61 urges the click teeth 64 to the click teeth 54, when the movable body 4 moves forward, engagement and disengagement of the click teeth 54 and 64 are repeated, and a sense of click (a sense of resistance) is given to the user every time the click teeth 54 and 64 are engaged or disengaged. This makes it easy to adjust an ejection amount of the coating material M.

When the main body cylinder 2 and the operation cylinder 3 are relatively rotated in the retracing direction (the other direction), the click female screw member 5 and the movable body 4 relatively rotate and the click teeth 54 and 64 also relatively rotates in synchronization with each other. Consequently, the screwing action of the screwing sections 8 works and the movable body 4 and the piston 9 move backward. In addition, since the elastic body 61 urges the click teeth 64 to the click teeth 54, when the movable body 4 moves backward, engagement and disengagement of the click teeth 54 and 64 are repeated, and a sense of click is given to the user every time the click teeth 54 and 64 are engage or disengaged. The excessively-ejected coating material M is drawn back by a decompression action in the main body cylinder 2 and the coating instrument 7 due to the backward movement of the piston 9.

Figure 7:
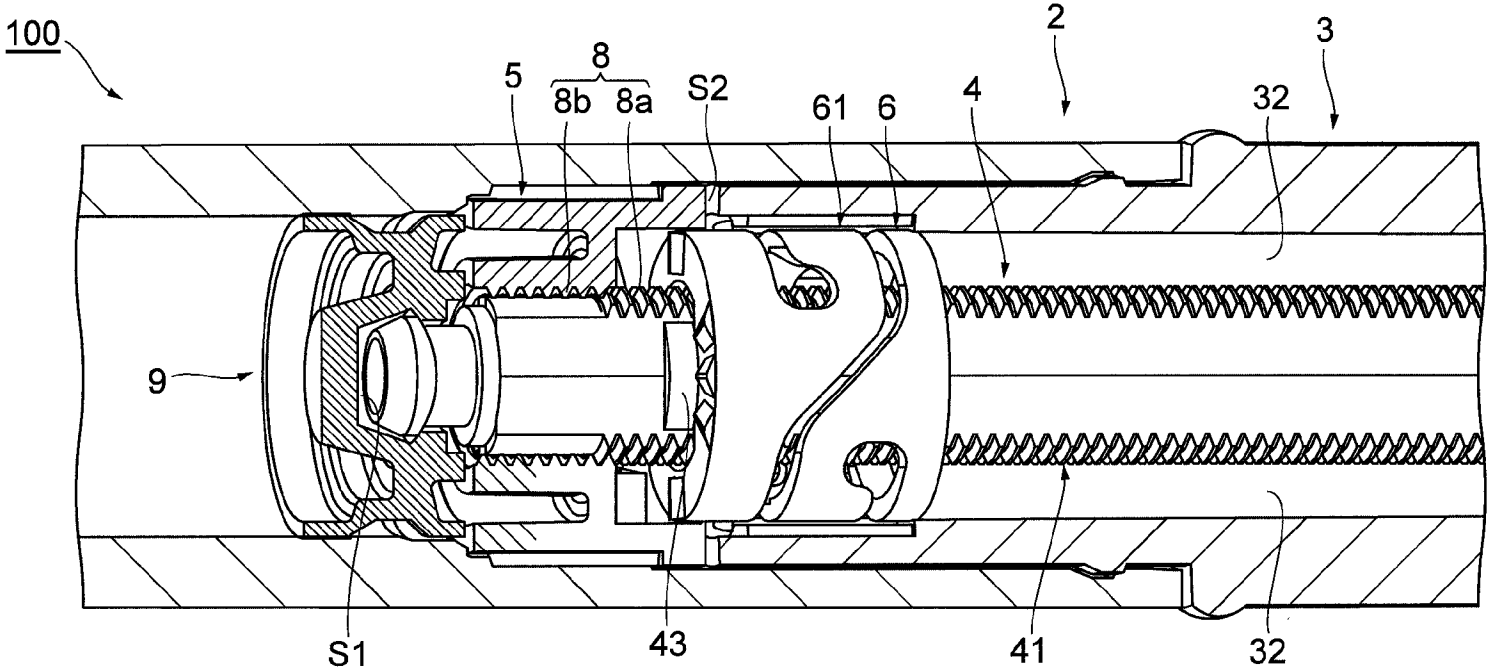
FIG. 7 is an enlarged sectional perspective view of the coating material extruding container shown in FIG. 1.

As shown in FIG. 7, when the movable body 4 is located at a backward movement limit as an initial state, if the main body cylinder 2 and the operation cylinder 3 are relatively rotated in a retracting direction, the male screw 8*a* of the movable body 4 comes off from the rear end of the female screw 8*b* of the click female screw member 5 following the backward movement of the movable body 4 and the screwing action of the screwing sections 8 is released (i.e., a clutch action functions). At the same time, while the spring member 6 is locked to the ridges 32 of the operation cylinder 3 such that the backward movement of the spring member 6 is prevented, the protrusion 43 of the movable body 4 is brought into contact with the front surface of the spring member 6, the spring member 6 is pressed backward (a backward movement direction) by the protrusion 43, and the elastic body 61 of the spring member 6 is compressed. Consequently, in a state in which this screwing action is released, the compression elastic force of the elastic body 61 is given to the protrusion 43 of the movable body 4 and the movable body 4 is urged to the front (a forward movement direction) as a screw-in direction. Therefore, after the movable body 4 moves backward and the screwing action is released, when the main body cylinder 2 and the operation cylinder 3 are relatively rotated in the extending direction, the male screw 8*a* of the movable body 4 is screwed in the rear end of the female screw 8*b* of the click female screw member 5 and the screwing sections 8 are reset to screw in.

Figure 8:
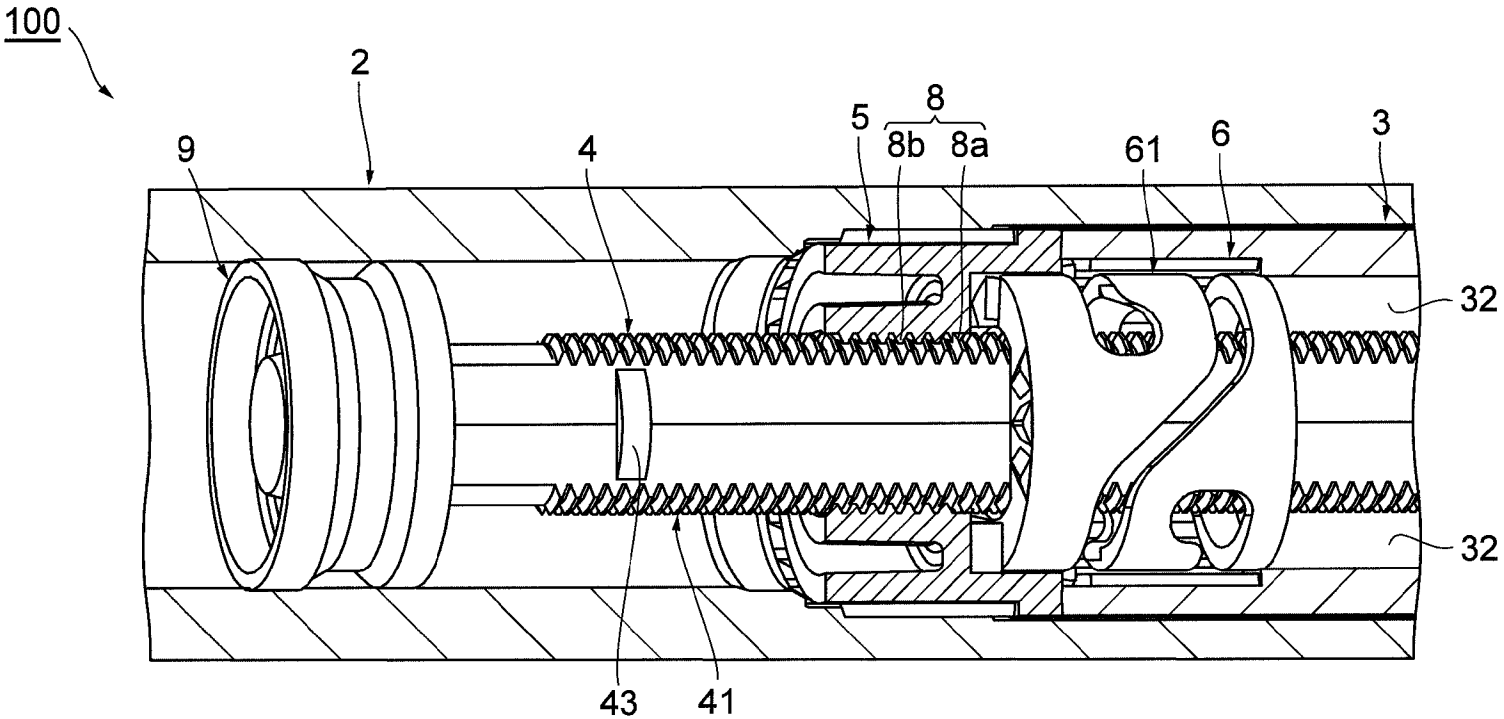
FIG. 8 is an enlarged sectional perspective view of the coating material extruding container at the time when the movable body moves forward by a predetermined amount from a state shown in FIG. 7.

On the other hand, as shown in FIG. 8, when the main body cylinder 2 and the operation cylinder 3 are relatively rotated in the extending direction from the initial state, the screwing action of the screwing sections 8 works a predetermined amount, and the movable body 4 moves forward, the click female screw member 5 is moves backward by the space S2 (see FIG. 7) by reaction (e.g., a force due to the influence of sliding resistance of the piston 9, resistance due to extrusion of the coating material M, reaction to the forward movement of the movable body 4, etc.) involved in the forward movement of the movable body 4. While the spring member 6 is locked to the ridges 32 of the operation cylinder 3 such that the backward movement of the spring member 6 is prevented, the spring member 6 is pressed backward by the moved click female screw member 5 and the elastic body 61 of the spring member 6 is compressed.

Figure 9:
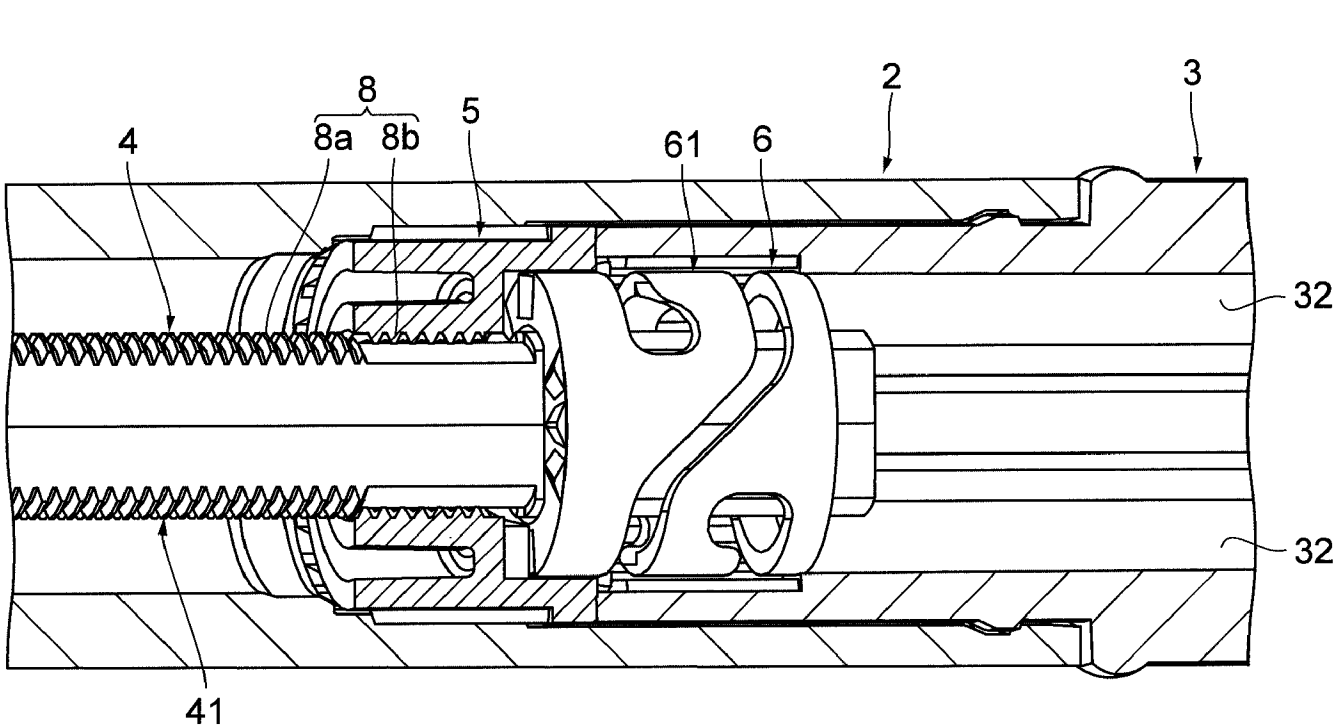
FIG. 9 is an enlarged sectional perspective view of the coating material extruding container at the time when the movable body moves forward to a forward movement limit from a state shown in FIG. 8.

As shown in FIG. 9, when the relative rotation in the extending direction of the main body cylinder 2 and the operation cylinder 3 is continued and the movable body 4 is located at the forward movement limit, if the main body cylinder 2 and the operation cylinder 3 are further relatively rotated in the extending direction, the male screw 8*a* of the movable body 4 comes off from the front end of the female screw 8*b* of the click female screw member 5 following the forward movement of the movable body 4 and the screwing action of the screwing sections 8 is released (i.e., the clutch action functions). In a state in which the screwing action is released, as explained above, since the elastic body 61 is compressed by the moved click female screw member 5, the compression elastic force of the elastic body 61 is given to the click female screw member 5 and the click female screw member 5 is urged forward in the screw-in direction. Therefore, after the movable body 4 moves forward and the screwing action is released, when the main body cylinder 2 and the operation cylinder 3 are relatively rotated in the retracting direction, the male screw 8*a* of the movable body 4 is screwed in the front end of the female screw 8*b* of the click female screw member 5 and the screwing sections 8 are reset to screw in.

As explained above, according to this embodiment, the elastic body 61 urges the click teeth 64 toward the click teeth 54. Consequently, engagement and disengagement of the click teeth 54 and 64 are repeatedly carried out following the movement of the movable body 4. A sense of click can always be generated. In addition, in the elastic body 61, when the movable body 4 moves backward according to the relative rotation in the retracting direction and the screwing action of the screwing sections 8 is released and when the movable body 4 moves forward according to the relative rotation in the extending direction and the screwing action of the screwing sections 8 is released, the screwing sections 8 are urged to be reset to screw in according to the relative rotation in the opposite direction. Consequently, after the movable body 4 moves and the screwing action is released, the screwing sections 8 can be reset to crew in.

In the coating material extruding container 100 according to this embodiment, it is possible to share the one elastic body 61 and realize both the giving of a sense of click according to the movement of the movable body 4 and the reset for screw-in of the screwing sections 8, the screwing action of which is released. Therefore, it is possible to generate a sense of click according to the movement of the movable body 4, reset the screwing sections 8 to screw in when the screwing action of the screwing sections 8 is released, and reduce the number of components. In particular, in this embodiment, the screwing sections 8 can be reset to screw in when the movable body 4 moves backward and the screwing action of the screwing sections 8 is released and when the movable body 4 moves forward and the screwing action of the screwing sections 8 is released.

In this embodiment, as explained above, the screwing sections 8 are formed as a single thread screw. Therefore, when the movable body 4 moves backward according to the relative rotation in the retracting direction and the screwing action of the screwing sections 8 is released and when the movable body 4 moves forward according to the relative rotation in the extending direction and the screwing action of the screwing sections 8 is released, if the movable body 4 further relatively rotates in the same direction, a sense of click is generated once for the full relative rotation according to the contact of the male screw 8*a* and the female screw 8*b* of the screwing sections 8. In other words, according to this embodiment, two types of senses of click, i.e., a sense of click always generated following the movement of the movable body 4 and a sense of click generated when the screwing action of the screwing sections 8 is released can be generated. The user can sense a forward movement limit or a backward movement limit.

In this embodiment, as explained above, since the screwing action of the screwing sections 8 is released when the movable body 4 is at the backward movement limit and at the forward movement limit, no load is applied to the screwing sections 8 even if the relative rotation of the main body cylinder 2 and the operation cylinder 3 is continued. Therefore, it is possible to prevent breakage of the screwing sections 8 and prevent breakage of the components of the coating material extruding container 100.

In this embodiment, as explained above, the male screw 8*a* is provided in the area other than the front end and the rear end in the small diameter outer circumferential surface 41*by* of the shaft 41 of the movable body 4. Therefore, for example, as shown in FIG. 9, the click female screw member 5 is located in the area of the shaft 41 where the male screw 8*a* is not provided. The movable body 4 and the click female screw member 5 are assembled with each other. In this state, the coating material extruding container 100 is assembled. This makes it unnecessary to screw in the male screw 8*a* of the movable body 4 and the female screw 8*b* of the click female screw member 5 in advance. As a result, it is possible to facilitate assembling of the coating material extruding container 100.

In this embodiment, as explained above, the screwing sections 8 are urged to be reset to screw in by the elastic force of the elastic body 51. However, the screwing sections 8 may be urged to be reset to screw in by an elastic force generated by elastic deformation (resin deformation) and warp (bend) of the components of the coating material extruding container 100. For example, when the screwing action is released at the forward movement limit, a returning force from the deformation of the piston 9 can be used as an elastic force.

In order to suitably realize the clutch action and the reset for screw-in of the screwing sections 8, the click female screw member 5 is disposed to be movable in the axial direction by the space S2 in the main body cylinder 1 and the movable body 4 is attached to be movable in the axial direction by the space S1 with respect to the piston 9. However, when the deformation of the components of the coating material extruding container 100 is taken into account, the spaces S1 and S2 do not have to be provided in some case.

A coating material extruding container according to a second embodiment of the present invention is explained.

Figure 10:
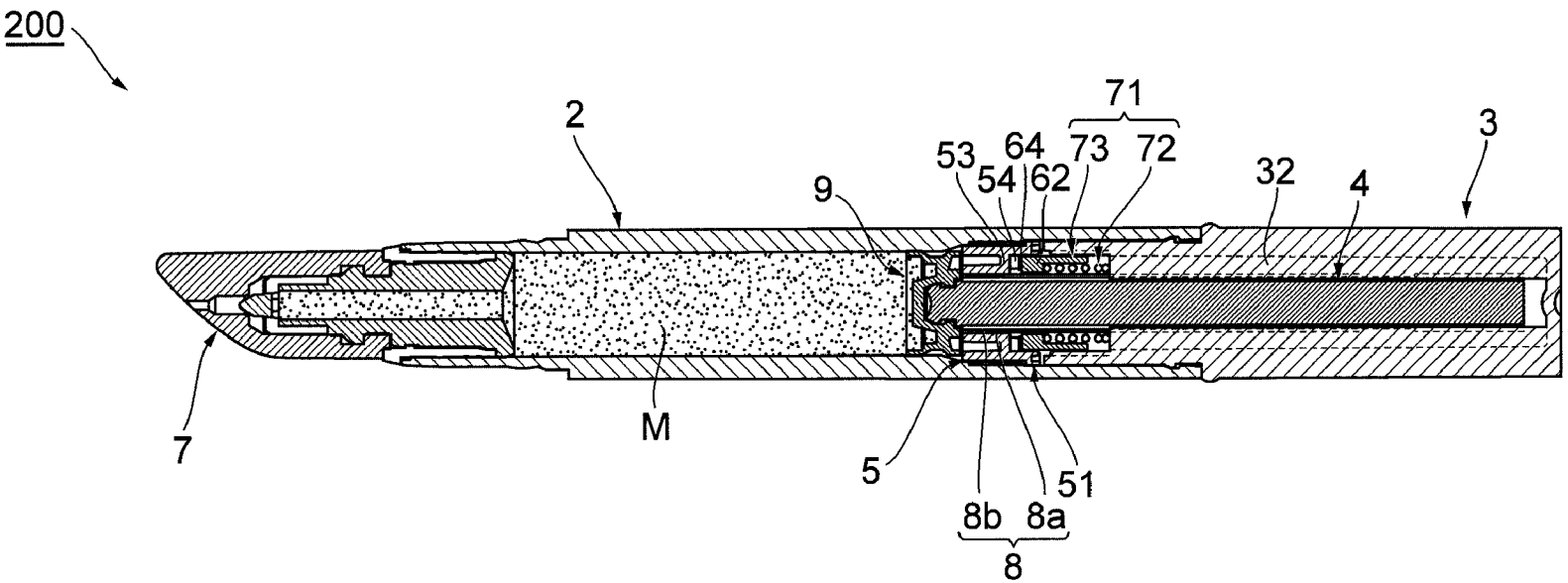
FIG. 10 is a longitudinal sectional view of an initial state of a coating material extruding container according to a second embodiment of the present invention.
Figure 11:
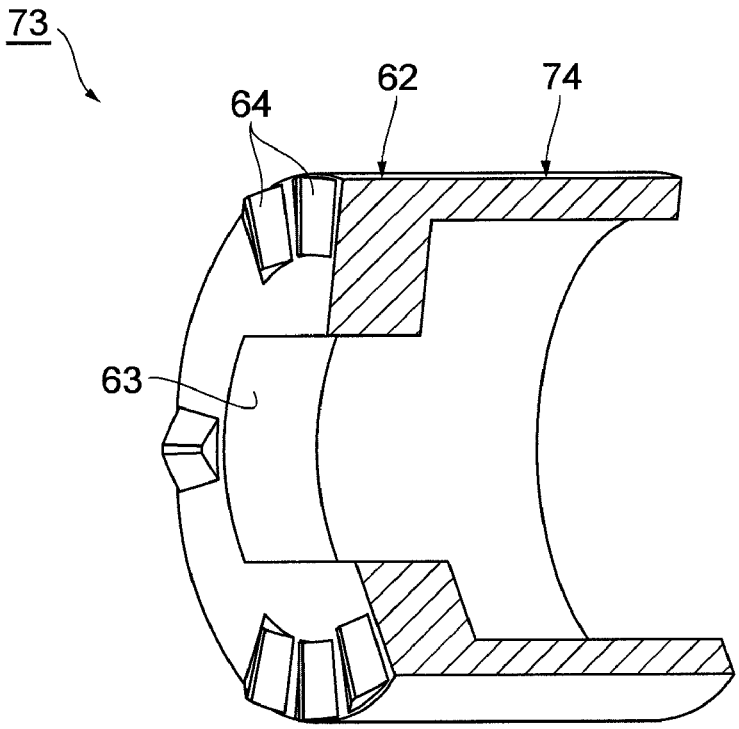
FIG. 11 is a sectional perspective view of a spring bearing of a spring member in the coating material extruding container.

FIG. 10 is a sectional view of an initial state of the coating material extruding container according to the second embodiment. FIG. 11 is a sectional perspective view of a spring bearing of a spring member. As shown in FIG. 10, a coating material extruding container 200 according to this embodiment is different from the coating material extruding container 100 (see FIG. 1) in that a spring member 71 is provided instead of the spring member 6 integrally formed of resin.

The spring member 71 includes a coil spring 72 as a metal coil spring. The coil spring 72 forms an elastic body having a predetermined elastic force in an axial direction (hereinafter referred to as elastic body 72). As shown in FIG. 11, the spring member 71 includes a spring bearing 73 that receives an urging force generated by the coil spring 72. The spring bearing 73 is an injection molded product of resin and is formed in a bottomed cylindrical shape opening to a rear side. The spring bearing 73 includes a cylindrical section 74 and a disc section 62 on a front end side of the cylindrical section 74. The length in the axial direction of the cylindrical section 74 is set shorter than the axial direction length of the elastic body 72.

In the spring member 71, as shown in FIG. 10, the coil spring 72 is coaxially inserted in the spring bearing 73 and the elastic body 72 is bumped against a rear surface of the disc section 62 of the spring bearing 73, whereby a front end of the elastic body 72 is housed in the spring bearing 73. The spring member 71 is arranged to be held between the coupling section 53 of the click female screw member 5 and the ridges 32 of the operation cylinder 3 such that the elastic body 72 is compressed by a predetermined amount in the axial direction between the coupling section 53 and the ridges 32.

Figure 12:
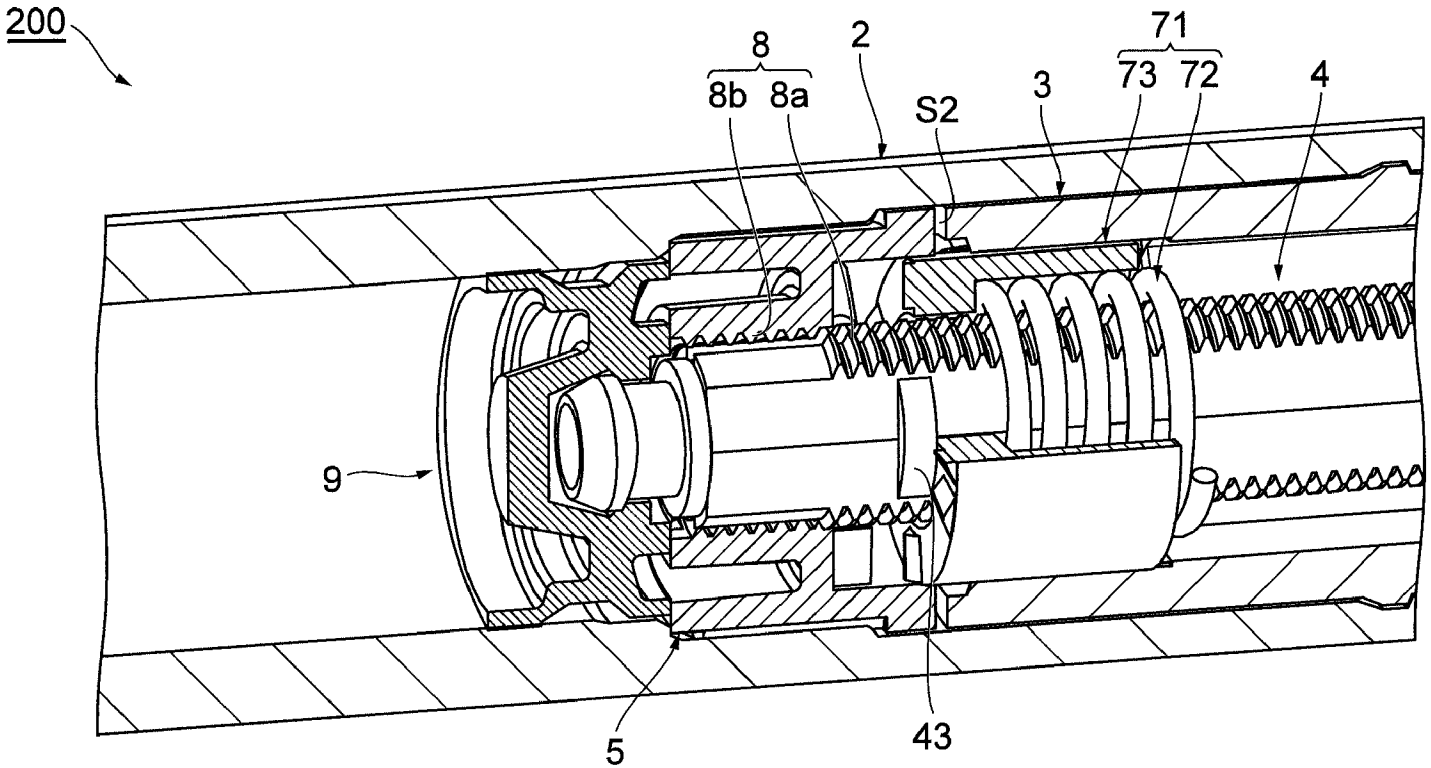
FIG. 12 is an enlarged sectional perspective view corresponding to FIG. 7 of the coating material extruding container shown in FIG. 10.
Figure 13:
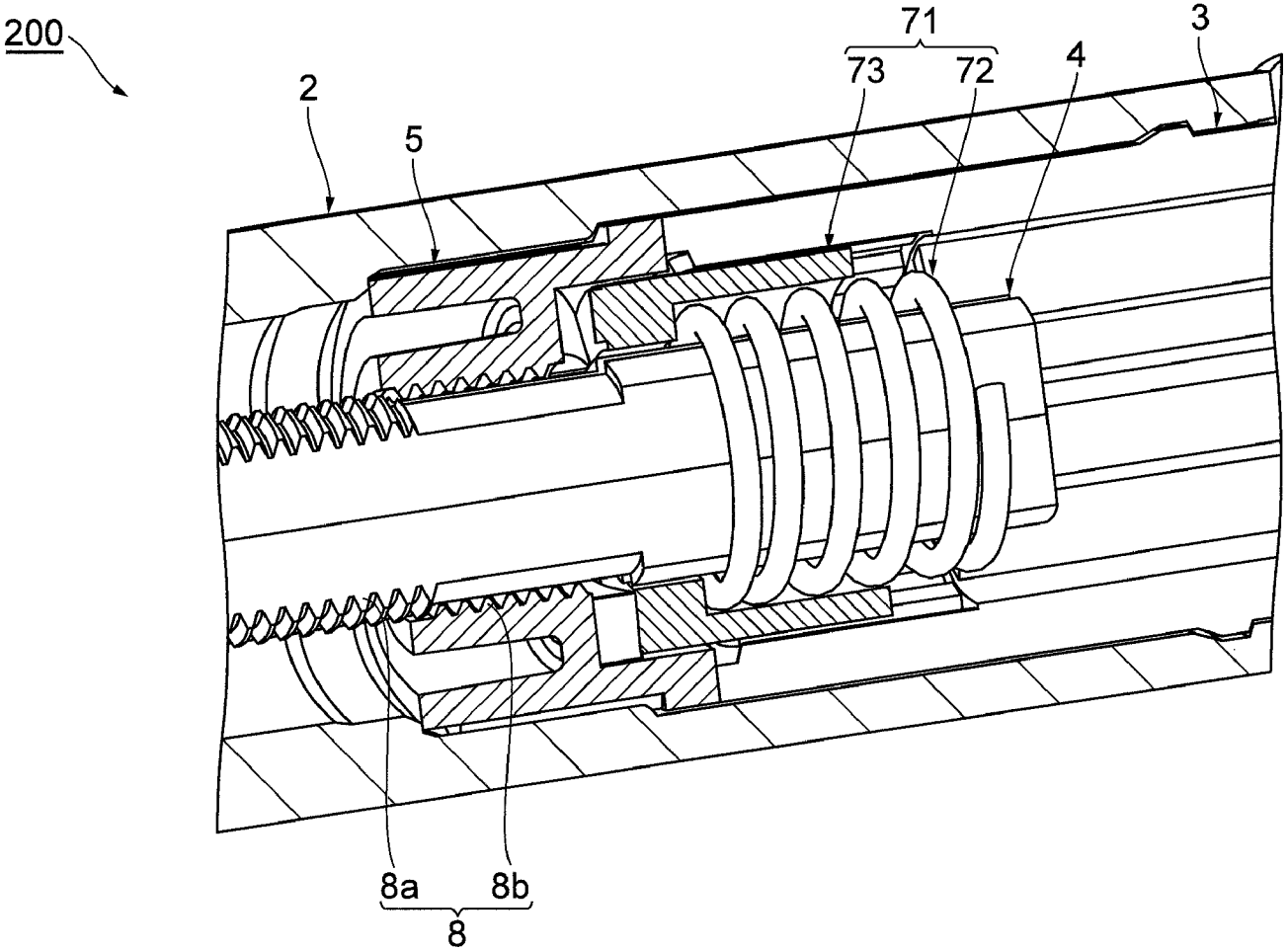
FIG. 13 is an enlarged sectional perspective view corresponding to FIG. 9 of the coating material extruding container shown in FIG. 10.

FIG. 12 is an enlarged sectional perspective view corresponding to FIG. 7 of the coating material extruding container shown in FIG. 10. FIG. 13 is an enlarged sectional perspective view corresponding to FIG. 9 of the coating material extruding container shown in FIG. 10. As shown in FIGS. 12 and 13, in the coating material extruding container 200 according to this embodiment, actions same as those of the coating material extruding container 100 are displayed.

As explained above, according to this embodiment, there is an effect same as that explained above, i.e., the effect that it is possible to generate a sense of click according to the movement of the movable body 4, reset the screwing sections 8 to screw in when the screwing action of the screwing sections 8 is released, and reduce the number of components. Further, in this embodiment, as explained above, since the metal coil spring is used as the elastic body 72, it is possible to prevent the elastic body 72 from being plastically deformed because of standing under a high-temperature condition.

The present invention is specifically explained on the basis of the embodiments. However, the present invention is not limited to the embodiments.

For example, in the embodiments, in order to press the spring member 6 or 71 backward to compress the elastic body 61 or 72, the click female screw member 5 is moved backward by the space S2 by reaction involved in the forward movement of the movable body 4. However, the click female screw member 71 may be moved backward as explained below. Before the main body cylinder 2 and the operation cylinder 3 are relatively rotated in the extending direction and the screwing action of the screwing sections 8 is released, the piston 9 is engaged in the axial direction in the main body cylinder 2 and the movable body 4 is brought into contact with the piston 9 in the axial direction, whereby the forward movement of the movable body 4 is prevented. In this state, the click female screw member 5 may be moved backward by further relatively rotating the main body cylinder 2 and the operation cylinder 3 in the extending direction and causing the screwing action of the screwing sections 8 to work without moving the movable body 4 forward.

In the embodiments, the elastic body urges the screwing sections to be reset to screw in when the movable body moves forward and the screwing action of the screwing sections is released and when the movable body moves backward and the screwing action of the screwing sections is released. However, the elastic body may urge the screwing sections to be reset to screw in when the movable body moves forward or moves backward and the screwing action of the screwing sections is released.

The male screw and the female screw may work like screw threads in the same manner as a protrusion group intermittently arranged or a protrusion group spirally or intermittently arranged. The coating material extruding containers 100 and 200 may be configured without the click teeth 54 and 56 provided. In this case, moderate and stable rotation resistance can be always given by the elastic bodies 61 and 72.

It goes without saying that the present invention can be used in a bar-like object extruding container that extrudes, as a coating material, a bar-like core and the like of various bar-like cosmetics such as a lipstick, a lip gloss, an eye liner, an eye color, an eye blow, a lip liner, a cheek color, a concealer, a cosmetic stick, and a hair color and writing instruments.

According to the present invention, it is possible to generate a sense of click according to the movement of the movable body, reset the screwing sections to screw in when the screwing action of the screwing sections is released, and reduce the number of components.

What is claimed is:

1. A coating material extruding container including a movable body and screwing sections in the container, in which, when a container front section and a container rear section rotatable relative to the container front section are relatively rotated in one direction, a screwing action of the screwing sections works, the movable body moves forward, a coating material is extruded from an opening at a distal end of the container and, when the container front section and the container rear section are relatively rotated in the other direction opposite to the one direction, the screwing action of the screwing sections works and the movable body moves backward, the coating material extruding container comprising:

click teeth for giving a sense of click according to the movement of the movable body following the relative rotation; and an elastic body having a predetermined elastic force, wherein the elastic body urges one of the click teeth toward the other of the click teeth, wherein, when the movable body moves backward according to the relative rotation in the other direction and the screwing action of the screwing sections is released, the elastic body urges the screwing sections to be reset to screw in according to the relative rotation in the one direction, wherein a male screw forming one of the screwing sections is provided in the movable body, wherein the movable body has a protrusion projecting in a direction crossing a moving direction, and wherein the movable body is urged forward by compressing the elastic body with the protrusion in a state in which the movable body moves backward according to the relative rotation in the other direction and the screwing action of the screwing sections is released.

2. The coating material extruding container according to claim 1, wherein the elastic body is externally inserted in the movable body, the movable body is formed in a bar shape and can move in an axial direction with respect to the elastic body, and in a state in which the movable body moves backward according to the relative rotation in the other direction and the screwing action of the screwing sections is released, the elastic body is compressed by pressing the elastic body backward with the protrusion while locking the elastic body to the container to prevent backward movement of the elastic body.

3. A coating material extruding container including a movable body and screwing sections in the container, in which, when a container front section and a container rear section rotatable relative to the container front section are relatively rotated in one direction, a screwing action of the screwing sections works, the movable body moves forward, a coating material is extruded from an opening at a distal end of the container and, when the container front section and the container rear section are relatively rotated in the other direction opposite to the one direction, the screwing action of the screwing sections works and the movable body moves backward, the coating material extruding container comprising:

click teeth for giving a sense of click according to the movement of the movable body following the relative rotation; and an elastic body having a predetermined elastic force, wherein the elastic body urges one of the click teeth toward the other of the click teeth, wherein, when the movable body moves forward according to the relative rotation in the one direction and the screwing action of the screwing sections is released, the elastic body urges the screwing sections to be reset to screw in according to the relative rotation in the other direction, wherein a male screw forming one of the screwing sections is provided in the movable body, wherein the movable body has a protrusion projecting in a direction crossing a moving direction, and wherein the movable body is urged forward by compressing the elastic body with the protrusion in a state in which the movable body moves backward according to the relative rotation in the other direction and the screwing action of the screwing sections is released.

4. The coating material extruding container according to claim 3, wherein the elastic body is externally inserted in the movable body, the movable body is formed in a bar shape and can move in an axial direction with respect to the elastic body, and in a state in which the movable body moves backward according to the relative rotation in the other direction and the screwing action of the screwing sections is released, the elastic body is compressed by pressing the elastic body backward with the protrusion while locking the elastic body to the container to prevent backward movement of the elastic body.

5. The coating material extruding container according to claim 3, wherein a female screw forming the other of the screwing sections is provided in a cylindrical female screw member, and the female screw member is urged forward by moving the female screw member in the axial direction to compress the elastic body in a state in which the movable body moves forward according to the relative rotation in the one direction and the screwing action of the screwing sections is released.

6. The coating material extruding container according to claim 5, wherein the movable body is formed in a bar shape and the male screw forming one of the screwing sections is provided on an outer circumferential surface thereof, and in a state in which the movable body moves forward according to the relative rotation in the one direction and the screwing action of the screwing sections is released, the elastic body is compressed by moving the female screw member backward with a reaction involved in the forward movement of the movable body and pressing the elastic body backward with the female screw member while locking the elastic body to the container to prevent backward movement of the elastic body.

7. A coating material extruding container including a movable body and screwing sections in the container, in which, when a container front section and a container rear section rotatable relative to the container front section are relatively rotated in one direction, a screwing action of the screwing sections works, the movable body moves forward, a coating material is extruded from an opening at a distal end of the container and, when the container front section and the container rear section are relatively rotated in the other direction opposite to the one direction, the screwing action of the screwing sections works and the movable body moves backward, the coating material extruding container comprising:

click teeth for giving a sense of click according to the movement of the movable body following the relative rotation; and an elastic body having a predetermined elastic force, wherein the elastic body urges one of the click teeth toward the other of the click teeth, wherein, when the movable body moves backward according to the relative rotation in the other direction and the screwing action of the screwing sections is released, the elastic body urges the screwing sections to be reset to screw in according to the relative rotation in the one direction, wherein, when the movable body moves forward according to the relative rotation in the one direction and the screwing action of the screwing sections is released, the elastic body urges the screwing sections to be reset to screw in according to the relative rotation in the other direction, wherein a male screw forming one of the screwing sections is provided in the movable body, wherein the movable body has a protrusion projecting in a direction crossing a moving direction, wherein the movable body is urged forward by compressing the elastic body with the protrusion in a state in which the movable body moves backward according to the relative rotation in the other direction and the screwing action of the screwing sections is released, wherein a male screw forming one of the screwing sections is provided in the movable body, wherein the movable body has a protrusion projecting in a direction crossing a moving direction, and wherein the movable body is urged forward by compressing the elastic body with the protrusion in a state in which the movable body moves backward according to the relative rotation in the other direction and the screwing action of the screwing sections is released.

8. The coating material extruding container according to claim 7, wherein a female screw forming the other of the screwing sections is provided in a cylindrical female screw member, and the female screw member is urged forward by moving the female screw member in the axial direction to compress the elastic body in a state in which the movable body moves forward according to the relative rotation in the one direction and the screwing action of the screwing sections is released.

9. The coating material extruding container according to claim 8, wherein the movable body is formed in a bar shape and the male screw forming one of the screwing sections is provided on an outer circumferential surface thereof, and in a state in which the movable body moves forward according to the relative rotation in the one direction and the screwing action of the screwing sections is released, the elastic body is compressed by moving the female screw member backward with a reaction involved in the forward movement of the movable body and pressing the elastic body backward with the female screw member while locking the elastic body to the container to prevent backward movement of the elastic body.

* * * * *